US005140217A

United States Patent [19]

Rao et al.

[11] Patent Number: 5,140,217

[45] Date of Patent: Aug. 18, 1992

[54] ELECTRIC LAMP HAVING A PUSH-IN FILAMENT INSERT FOR FILAMENT MOUNTING

[75] Inventors: Raghunatha S. Rao, Lexington, Ky.; Oscar H. Longo, Carolina, P.R.

[73] Assignee: North American Philips Corporation, New York, N.Y.

[21] Appl. No.: 580,245

[22] Filed: Sep. 7, 1990

[51] Int. Cl.[5] ..... H01J 19/42

[52] U.S. Cl. ..... 313/274; 313/271; 313/278; 313/285; 313/623; 140/71.6

[58] Field of Search ..... 313/271, 274, 285, 623, 313/278; 140/71.6, 71.5

[56] References Cited

U.S. PATENT DOCUMENTS 2,342,044 2/1944 Foote ..... 313/274
2,830,217 4/1958 Hodge ..... 313/274
3,189,778 6/1965 Brundige ..... 313/331
3,376,460 4/1968 Jameson ..... 313/274

FOREIGN PATENT DOCUMENTS 62-26900 2/1987 Japan .
1340778 12/1972 United Kingdom .

*Primary Examiner*—Donald J. Yusko
*Assistant Examiner*—Nimeshkumar D. Pahl
*Attorney, Agent, or Firm*—Brian J. Wieghaus

[57] ABSTRACT

An electric lamp having a filament with open coiled ends and filament inserts have an end insertable into the open filament ends without threading cooperation and lockingly engage the filament turns. The ends of the filament inserts provide a resilient ratchetted coupling with the successive turns of the coiled filament ends. The filament inserts replace integral coil legs for coil mounting in the lamp.

14 Claims, 2 Drawing Sheets

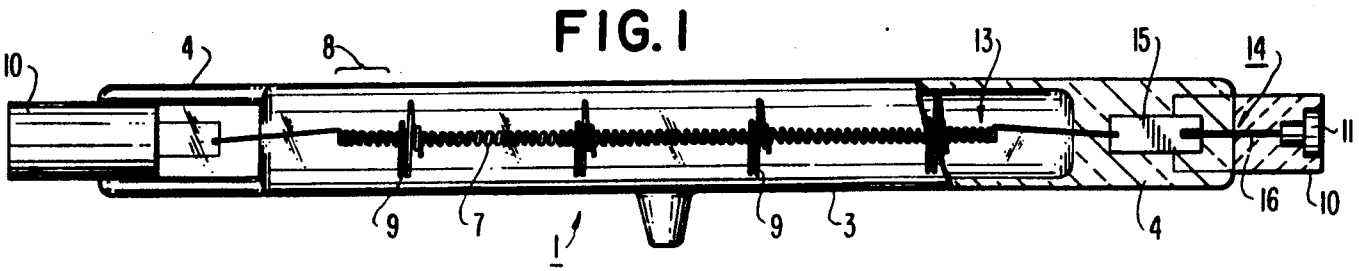
FIG. 1
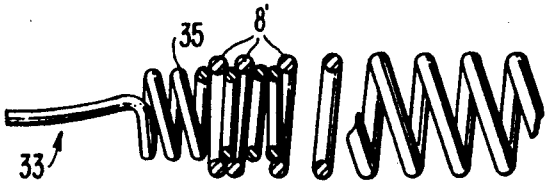
FIG. 2
PRIOR ART
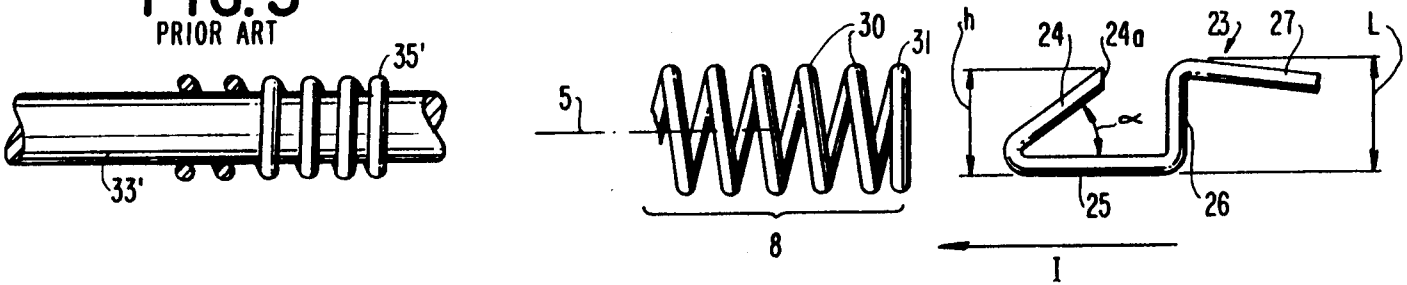
FIG. 4(a)
FIG. 3
PRIOR ART FIG. 4(b)
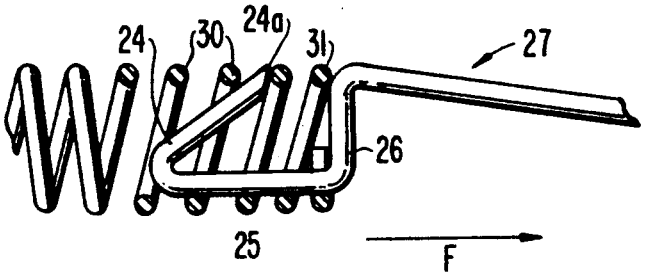
FIG. 5(a)
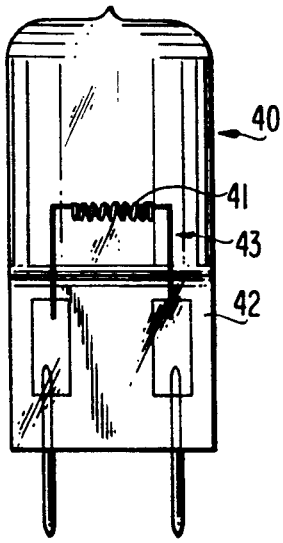
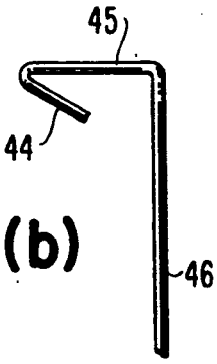
FIG. 5(b)

ELECTRIC LAMP HAVING A PUSH-IN FILAMENT INSERT FOR FILAMENT MOUNTING

BACKGROUND OF THE INVENTION

1. Field of the Invention

The invention relates to incandescent lamps, and more particularly, to incandescent lamps having filament inserts inserted into the open ends of coiled filaments for mounting the filament in the lamp.

2. Description of the Prior Art

A majority of incandescent lamps have coiled tungsten filaments with integral legs extending from the opposite ends of the filament coil for mounting the filament in the lamp. The legs may be clamped to conductive lead-ins extending into the lamp envelope or may extend through a sealed wall of the envelope to the exterior.

According to one method of filament manufacture, a series of filaments are formed by continuously winding a plurality of filament sections of desired length and pitch onto a molybdenum mandrel, the filament legs being turns of much lower pitch formed on the mandrel between the adjacent coiled filament sections. After annealing of the filament sections on the mandrel, the mandrel is severed between the filament sections and the molybdenum mandrel is removed, for example, in an acid bath. This yields individual filament coils with legs at each end, which legs may be further bent and/or cut to length for mounting the filament in the lamp envelope.

In the manufacture of certain incandescent lamps, however, the filament legs have proven to be problematic. For example, in halogen lamps where lamp cleanliness is of great importance, it is desirable to further heat the filaments on tungsten mandrels in an inert atmosphere before assembly in the lamp envelope to drive out impurities and to crystallize the filament coil. It has been found that the filament legs often are not heated to the same extent as the filament turns, resulting in a brittle transition between the leg and the respective filament end turn. This has resulted in an undesirable number of filament failures caused by the legs breaking off during further filament processing and sealing of the filaments in the lamp envelope.

In tubular infrared or flood lamps having an elongate filament arranged in a tubular envelope, the filament is provided during lamp processing with spiral wire supports to center the filament with respect to the envelope. The presence of filament legs in these lamps is also disadvantageous because the legs take up extra space and reduce the batch processing speed for winding the spirals on the filaments.

Thus, in various lamp types, it has proven economically feasible to make filament coils without legs, or to severe the legs, and at a later processing stage to use filament inserts inserted into the open coiled filament ends for supporting and electrically connecting the filament in the lamp envelope. The known filament inserts are threaded into open coiled ends of the filament. One form of insert, shown in FIG. 2, consists of a length of wire 33 having a coiled end with turns 35 of the same pitch as the filament coil 8'. The coiled end of the insert has an outside diameter selected such that it threads into the coiled end of the filament. Another known insert, shown in FIG. 3, consists of a rod 33' having a separate coil winding 35' also sized to thread into the inside of the filament coil.

Both of these insert designs have the disadvantage that they are labor intensive. It is difficult to begin the threading of the insert into the filament coil and the inserts must also be rotated a significant number of times to completely thread the insert into the filament coil, which is time consuming. Additionally, these inserts do not provide a simple mechanism for determining the insertion depth of the insert. Improper insertion depth can adversely effect the positioning and/or tension of the mounted filament. The latter has the additional disadvantage that two pieces of wire are required to form the insert, and the coil must be secured to the rod.

SUMMARY OF THE INVENTION

Accordingly, it is an object of the invention to provide a filament insert, and a lamp having such an insert, which can be lockingly inserted into the open coiled end of a filament without threading cooperation between the insert and the coiled end.

It is yet another object of the invention to provide a filament insert which can be linearly pushed into the coiled end of a filament substantially along the axis of the coiled end.

Still another object of the invention is to provide a filament insert formed from a single length of wire and which is less costly to manufacture than the known filament inserts.

It is yet another object of the invention to provide a filament insert having an easily controlled insertion depth.

The incandescent lamp according to the invention comprises a hermetically sealed light transmissive envelope having a coiled filament arranged within the envelope and energizable for emitting light. The filament comprises a length of coiled wire having an open coiled end having successive coil turns and terminating at an end turn. The filament insert comprises a resilient portion resiliently deformable for ratchetting over successive coil turns of the coiled filament end and, insertable into for lockingly engaging the coil turns and preventing removal of the insert from the coiled filament end.

In a preferred embodiment of the invention, the one end of the insert is "V"shaped and consists of a guide leg and an adjoining resilient pawl leg angled with respect to the guide leg and having an end resiliently biased against the coil turns. The pawl leg is angled with respect to the guide leg and has a length chosen for ratchetting over the coil turns in the insertion direction of the filament insert into the open coiled end and for locking against a coil turn in the opposite direction to prevent removal of the filament insert from the filament. The guide leg has a length chosen for preventing rotation of said insert about an axis perpendicular to the length dimension of the insert caused by the reaction of the pawl leg against the coil turns.

In another preferred embodiment of the invention, the insert comprises a limit stop for limiting the insertion of the filament insert into the filament. Preferably, the limit stop consists of a limit leg extending from the guide leg perpendicular to the guide leg and radially past the outside diameter of the coiled filament end. Preferably the limit leg is spaced from the end of said locking leg such that several coil turns are clamped between the limit leg and the end of the pawl leg when the filament insert is inserted into the coiled filament end.

According to another preferred embodiment of the invention the filament insert consists of a single length of wire and is planar.

Further details and advantages of the invention will become apparent from the drawings and following description of the preferred embodiment.

BRIEF DESCRIPTION OF THE DRAWING

FIG. 1 a tubular halogen incandescent lamp according to the invention;

FIG. 2 shows a first coil insert according to the prior art;

FIG. 3 second coil insert according to the prior art;

FIG. 4(*a*) shows the filament insert according to the preferred embodiment of the invention; FIG. 4(*b*) shows the filament insert of 4(*a*) lockingly inserted in a coiled filament end portion; and FIGS. 5(*a*) and 5(*b*) show a single-ended halogen lamp and insert according to another embodiment of the invention.

DESCRIPTION OF THE PREFERRED EMBODIMENT

FIG. 1 shows a tubular halogen floodlamp 1 having a light transmissive envelope 3 hermetically sealed by pinch seals 4. A coiled tungsten filament 7 is supported within the tubular envelope 3 by spiral wire supports 9, which engage the inside wall of the lamp envelope. The filament 7 is electrically connected to contacts 11 on lamp caps 10 through tungsten filament inserts 13 and conductive lead-throughs 14. The lead-throughs 14 consist of a molybdenum foil 15 and conductor 16. The ends of the filament inserts 13 and conductors 16 are welded to the molybdenum foils 15 in a conventional manner. The filament is energized for emitting light by connecting a power supply across contacts 11. In addition to an inert gas such as argon, the envelope has a filling of a halogen sufficient for a halogen tungsten-transport cycle to be maintained during lamp operation.

FIGS. 4(*a*) and 4(*b*) show the filament insert according to the preferred embodiment of the invention used in the lamp of FIG. 1. The filament, insert 23 consists of a single length of tungsten wire having a guide leg 25 and resilient pawl leg 24. The pawl leg 24 is angled with respect to the guide leg 25, and has a length chosen, such that the end 24*a* of the pawl leg resiliently rides with ratchetting motion over the inside surface of coil turns 30 during insertion, in the direction indicated by arrow "I", into the coiled filament end 8. Since the pawl leg ratchets over the coil turns, the coil-locking means may be linearly pushed into the coiled filament end substantially along the axis 5 of the coiled end without rotation or threading cooperation with the coiled end.

The guide leg 25 has a length chosen for preventing rotation of the coil insert about an axis normal to the direction of insertion of the filament insert. The guide leg 25 prevents the insert from rotating within the coiled end 8 so that the end 24*a* and leg 24 do not protrude out between the turn 30 when a force "F" is applied to the insert. (FIG. 4(*b*)) The diameter of the insert wire is also selected for preventing the end 24*a* from protruding through the interstices between the filament turns. The guide leg provides enough surface contact with the turns 30 to maintain sufficient electrical contact with the filament. After insertion, as shown in FIG. 4(b), the end 24*a* of locking leg 24 lockingly engages a coil turn 30 to prevent removal of the insert 23 in the opposite direction from the filament.

To control the insertion depth of the filament insert, limit leg 26 extends from guide leg 25, normal to leg 25 and in the radial direction of the filament, with a length sufficient to engage coil end turn 31, thereby functioning as limit stop to limit the insertion depth of the insert. Tail 27 extends from the limit leg 25 and is welded to molybdenum foil 14 for assembly in the lamp.

Preferably, each of the legs 24, 25, 26 and tail 27 lie in a common plane. This facilitates bending of the insert wire, allowing rapid and cost effective manufacturing of the inserts.

In the preferred embodiment of the invention, the length dimension "L" of limit leg 26 is approximately 20 percent larger than the coil outside diameter (O.D.). The angle $\alpha$ of the locking leg 24 with respect to the guide leg 25 was approximately 45 degrees and the height "h" of the locking leg was approximately 20 percent larger than the coil inside diameter (I.D.) The diameter of the wire for the filament insert was approximately 25 percent larger than the diameter of filament wire.

In the lamp according to FIG. 1, the diameter of the tungsten filament wire was 7 mils and the diameter of the filament insert wire was 10 mils. The coiled filament end had an inside diameter (I.D.) of 46 mils and an outside diameter (O.D.) of 60 mils. The dimensions "h" and "L" were 1.4 mm and 1.8 mm, respectively.

FIG. 5(*a*) shows another embodiment of a lamp according to the invention. The lamp 40 is a single-ended tungsten halogen incandescent lamp having a tungsten filament 41. Filament inserts 43 of molybdenum wire support the filament and extend through the pinch seal 42 in a gas-tight manner to provide electrical connection to the filament. As shown in FIG. 5(*b*), the inserts 43 have a guide leg 45 and a resilient pawl leg 44. The tail 46 extends perpendicularly from the guide leg 45 through the pinch seal 42, and also butts against the coil end turn for limiting the insertion depth of the filament insert into the coiled filament end.

While there has been shown what is presently considered to be the preferred embodiments of the invention, it will be apparent to those of ordinary skill in the art that various changes and modifications can be made to the filament insert and lamp without departing from the scope of the invention as defined by the appended claims.

For example, the end of the wire 24*a* may be flattened prior to bending to increase its width and vary its holding power against coil turns 30. The insert is not limited to wire having circular cross section but may have other cross sections, such as rectangular. Alternatively, the insert may be fabricated from a strip of metal.

Those of ordinary skill in the art will also appreciate that the filament insert is not limited to filament coils without conventional filament legs but may be used to provide additional support for the filament while conventional filament legs are used for energizing the filament.

We claim:

1. In an electric incandescent lamp having a hermetically sealed light transmissive envelope, a coiled filament arranged within said envelope and energizable for emitting light, said filament having an open coiled end of successive coil turns and terminating at an end turn, and a filament insert insertable into said open coiled end, the improvement comprising:

said filament insert having a resilient portion resiliently deformable for ratchetting over said coil turns in the insertion direction of said insert into said open coiled end and for lockingly engaging said coil turns and preventing removal of said insert of said filament.

2. In an electric lamp as claimed in claim 1, wherein said filament insert comprises a guide leg and an adjoining resilient pawl leg angled with respect to said guide leg and having an end biased against said coil turns, said guide leg having a length chosen for preventing rotation of said insert within said coiled end about an axis perpendicular to the length dimension of said insert, said pawl leg being angled and having a length chosen for resiliently ratchetting over said coil turns in the insertion direction of said filament insert and for locking against a coil turn in the opposite direction for preventing removal of said filament insert form said coiled filament end.

3. In an electric lamp as claimed in claim 2, wherein said insert comprises a limit leg extending from said guide leg perpendicular to said guide leg and extending radially past said coil end turn for limiting the insertion of said leg into said coiled end.

4. An incandescent lamp as claimed in claim 3, wherein said insert consists of a single length of wire.

5. An incandescent lamp as claimed in claim 4, wherein said insert is planar.

6. In an electric lamp as claimed in claim 1, wherein said insert comprises a limit stop for limiting the insertion depth of said insert into said coiled filament end.

7. A filament insert for insertion into an open coiled end for filament mounting in an electric lamp, said insert comprising:

a resilient portion resiliently deformable for ratchetting over successive coil turns of the coiled filament end and for lockingly engaging the coil turns and preventing removal of said insert from said coiled filament end.

8. A filament insert as claimed in claim 7, wherein said filament insert comprises a guide leg and an adjoining resilient pawl leg angled with respect to said guide leg and having an end for biasing against the coil turns of a filament, said guide leg having a length chosen for preventing rotation of said insert within a filament coiled end about an axis perpendicular to the length dimension of said insert, and said pawl leg being angled for resiliently ratchetting over the coil turns in the insertion direction of said filament insert and for locking against a filament coil turn in the opposite direction for preventing removal of said insert from the filament.

9. A filament insert as claimed in claim 8, further comprising a limit leg extending from said guide leg perpendicular to the guide leg and extending radially a distance greater than said locking leg for limiting the insertion depth of said insert in a filament coiled end.

10. An incandescent lamp as claimed in claim 9, wherein said insert consists of a single length of wire.

11. An incandescent lamp as claimed in claim 10, wherein said insert is planar.

12. A filament insert as claimed in claim 7, further comprising a limit leg extending from said guide leg perpendicular to the guide leg and extending radially a distance greater than said pawl leg for limiting the insertion depth of said insert in a filament coiled end.

13. An incandescent lamp as claimed in claim 7, wherein said insert consists of a single length of wire.

14. An incandescent lamp as claimed in claim 7, wherein said insert is planar.

* * * * *